US012690729B2

(12) United States Patent
Longenecker et al.

(10) Patent No.: US 12,690,729 B2
(45) Date of Patent: Jul. 28, 2026

(54) ROTATABLE SPLASH GUARD

(71) Applicant: ARTSANA USA, INC., Lancaster, PA (US)

(72) Inventors: Michael L. Longenecker, Lancaster, PA (US); Kyle David Narkiewicz, Lancaster, PA (US)

(73) Assignee: Artsana USA, Inc., Lancaster, PA (US)

( * ) Notice: Subject to any disclaimer, the term of this patent is extended or adjusted under 35 U.S.C. 154(b) by 76 days.

(21) Appl. No.: 18/667,407

(22) Filed: May 17, 2024

(65) Prior Publication Data

US 2024/0423425 A1 Dec. 26, 2024

Related U.S. Application Data

(60) Provisional application No. 63/509,049, filed on Jun. 20, 2023.

(51) Int. Cl.
*A47K 13/06* (2006.01)
*A47K 13/24* (2006.01)

(52) U.S. Cl.
CPC ..... *A47K 13/06* (2013.01); *A47K 13/24* (2013.01)

(58) Field of Classification Search
CPC ..... A47K 13/06; A47K 13/08; A47K 13/24; A47K 11/04; A47K 11/06; Y10S 4/05
See application file for complete search history.

(56) References Cited

U.S. PATENT DOCUMENTS 1,737,572 A * 12/1929 Costigan ..... A47K 13/24 4/144.1
1,857,328 A * 5/1932 Piper ..... A47K 17/00 4/144.1
2,100,774 A 11/1937 Puy et al.
2,545,598 A * 3/1951 Barnes ..... A47K 13/06 4/239
2,686,320 A 8/1954 Feldstein
2,709,816 A * 6/1955 Lamb ..... A47K 13/08 4/239
2,850,744 A 9/1958 Nika et al.
2,955,296 A * 10/1960 Zapolski ..... A47K 13/06 297/250.1
3,153,248 A 10/1964 Miller
3,371,356 A 3/1968 Benjamin
4,516,279 A * 5/1985 Block ..... A47K 13/06 4/240
4,716,602 A 1/1988 Brickhouse
5,161,263 A 11/1992 Geneve et al.
5,182,818 A 2/1993 Nawoj
5,778,460 A 7/1998 Doell et al.
5,978,976 A 11/1999 Chai (Continued)

*Primary Examiner* — Erin Deery
(74) *Attorney, Agent, or Firm* — Saxton & Stump, LLC

(57) ABSTRACT

A child's toilet training potty seat positionable on a toilet, the potty seat having a seating surface configured to support a child and a receptacle configured to rotatably attach a splash guard adjacent to a forward portion of the seating surface, the splash guard having a projection engageable in the receptacle and allowing rotation thereof. The projection is eccentrically located on the guard so that guard rotation positions the then-upward end of the guard comparatively higher or lower in relation to the seat. A higher positioned upward end is suitable for use with boys. A lower positioned upward end is suitable for use with girls.

14 Claims, 14 Drawing Sheets

(56) References Cited

U.S. PATENT DOCUMENTS

| | | | | |
|---|---|---|---|---|
| 6,408,447 | B1 | 6/2002 | Burbank et al. | |
| 7,461,411 | B2 | 12/2008 | Wolf | |
| 10,478,024 | B2 | 11/2019 | Del Duke et al. | |
| 11,266,277 | B2 * | 3/2022 | Pang | A47K 13/24 |
| 2007/0017015 | A1 | 1/2007 | Finell | |
| 2008/0086804 | A1 | 4/2008 | Goh Aow | |
| 2014/0259338 | A1 | 9/2014 | Welch et al. | |

* cited by examiner

ROTATABLE SPLASH GUARD

CROSS-REFERENCE TO RELATED APPLICATIONS

This application claims priority benefit to provisional patent application 63/509,049 filed on Jun. 20, 2023, the entirety of which is incorporated by reference herein.

FIELD OF THE INVENTION

The present disclosure is generally directed to child's potty seat, and more particularly to a rotatable splash guard for a potty seat that may be quickly and conveniently repositioned to accommodate male and female users.

BACKGROUND OF THE INVENTION

Many types of toilet training devices which facilitate the use of toilets by children are known. Toilet, or potty seats adapted for use on conventional toilets or as stand-alone toilets are specially designed for use by children. Such potty seats may include splash shields to deflect and direct errant spray into the toilet, especially if the potty seat is optimized for boys.

Consumer parents prefer products that may be adapted to suit their children as they grow or to provide utility for multiple children. Many families include children of both genders. Parents soon discover that the toilet training experience is dramatically different for boys and girls. Known potty seats are configured to accommodate both sexes, lacking any specific features to account for their different needs, or optimized for one sex, typically boys. Gender-neutral potty seats may not fully address the needs of both sexes, particularly when it comes to deflecting and redirecting errant spray or splash, while seats optimized for boys may be uncomfortable for use by girls. Adaptable splash shields may also be necessary for a period of time after the child has grown and can use the standard toilet seat.

What is needed is a reconfigurable splash guard for use with a potty seat or a conventional toilet seat that is easily configured for use with either boys or girls seated on the seat that will contain spray and direct it into the toilet or collection container. The splash guard should be removeable to allow for easy cleaning. Other features and advantages will be made apparent from the present specification. The teachings disclosed extend to those embodiments that fall within the scope of the claims, regardless of whether they accomplish one or more of the aforementioned needs.

SUMMARY OF THE INVENTION

Accordingly, the present invention, in any of the embodiments described herein, may provide one or more of the following advantages:

It is an object of the present invention to provide a child's toilet training potty seat that is adaptable for use by both boys and girls that includes a seat positionable on a toilet or collector container and a rotatable splash guard connected to the potty seat that may be secured in a first position optimized for boys and a second position optimized for girls. The seat has an upwardly-facing surface configured to support a seated child atop the potty seat. The rotatable guard, when in the first position, has an uppermost edge located higher relative to the surface of the seat than an uppermost edge of the shield when the guard is rotated to the second position.

It is another object of the present invention to provide a rotatable splash guard that is attachable to a conventional toilet seat by a mounting device that is asymmetrically disposed on the splash guard to locate the upward-oriented end of the splash guard in a comparatively higher or lower position in relation to the seat dependent upon the rotational orientation of the splash guard. The splash guard mounting device may include a resilient strap to encircle the toilet seat and secure the splash guard thereto.

It is another object of the present invention to provide a rotatable splash guard for use on a child's toilet training potty seat wherein the seat includes a mounting receptacle configured to selectively receive a protection on the rotatable guard and enable the guard to be rotated. The projection is eccentrically located on the guard so that rotation causes an upward end of the guard to be located in a comparatively higher or lower position in relation to the seat. The seat further includes a detent engageable by a fixing structure on the shield to restrain the shield in either a first position or a second position.

It is a further object of the present invention to provide a rotatable splash shield for a child's potty-training seat wherein rotating the splash guard repositions the splash shield in relation to a surface of the potty seat to optimally position the splash shield for either girls or boys using the potty seat.

It is a still further object of the present invention to provide a rotatable splash guard for a child's potty-training seat that is durable in construction, inexpensive of manufacture, carefree of maintenance, easily assembled, and simple and effective to use.

These and other objects of the present invention are achieved in a child's toilet training potty seat positionable on a toilet, the potty seat having a seating surface configured to support a child and a receptacle configured to rotatably attach a splash guard adjacent to a forward portion of the seating surface, the splash guard having a projection engageable in the receptacle and allowing rotation thereof. The projection is eccentrically located on the guard so that guard rotation positions the then-upward end of the guard comparatively higher or lower in relation to the seat. A higher positioned upward end is suitable for use with boys. A lower positioned upward end is suitable for use with girls.

Other features and advantages of the present invention will be apparent from the following more detailed description of the preferred embodiment, taken in conjunction with the accompanying drawings which illustrate, by way of example, the principles of the invention.

BRIEF DESCRIPTION OF DRAWINGS

The advantages of this invention will be apparent upon consideration of the following detailed disclosure of the invention, especially when taken in conjunction with the accompanying drawings wherein.

Wherever possible, the same reference numbers will be used throughout the drawings to represent the same parts.

DETAILED DESCRIPTION OF THE INVENTION

Many of the fastening, connection, processes and other means and components utilized in this invention are widely known and used in the field of the invention described, and their exact nature or type is not necessary for an understanding and use of the invention by a person skilled in the art, and they will not therefore be discussed in significant detail. Also, any reference herein to the terms "up" or "down," or "top" or "bottom" are used as a matter of mere convenience and are determined with reference to a floor or similar surface. Furthermore, the various components shown or described herein for any specific application of this invention can be varied or altered as anticipated by this invention and the practice of a specific application of any element may already be widely known or used in the art by persons skilled in the art and each will likewise not therefore be discussed in significant detail.

Figure 1:
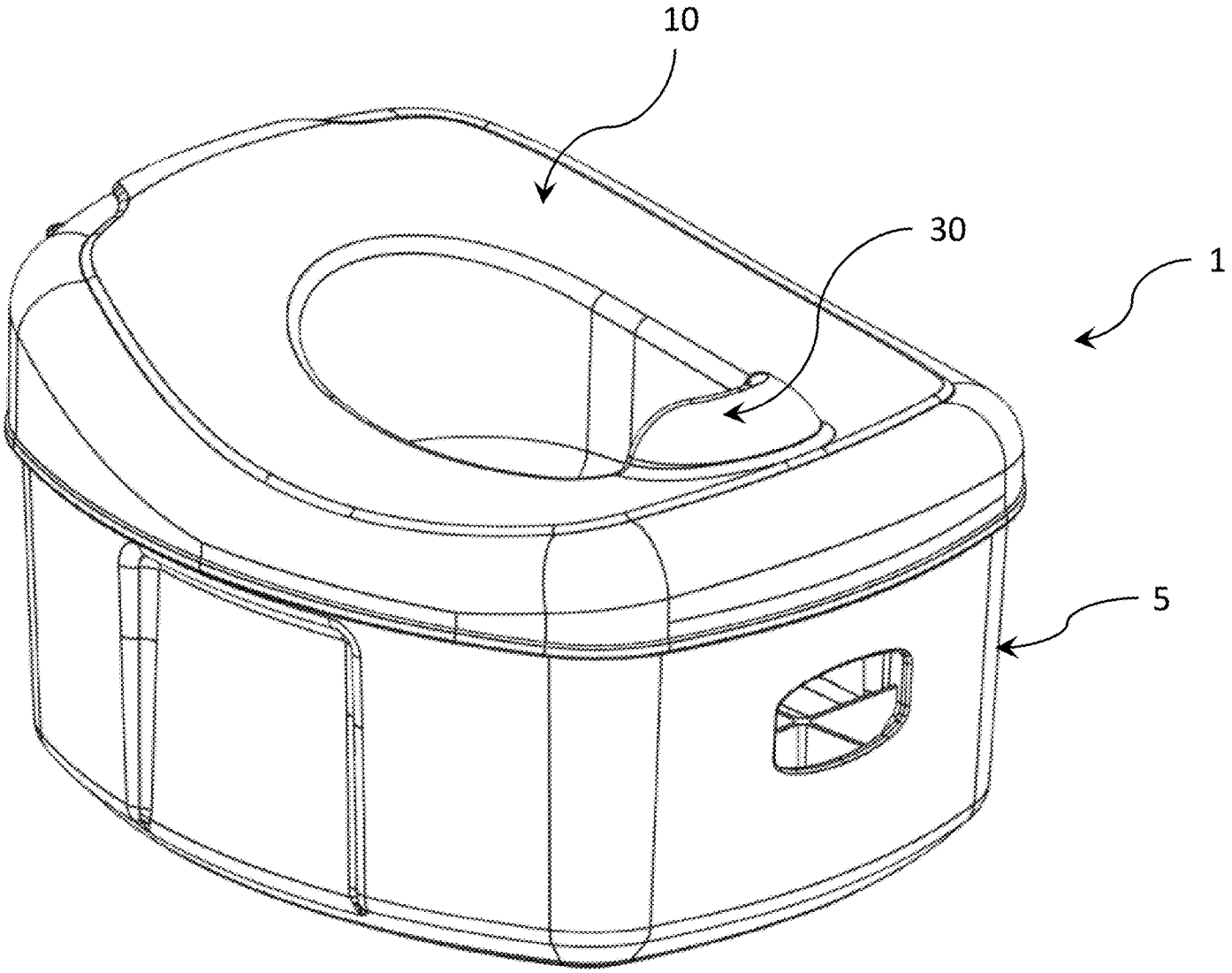
FIG. 1 is a view of a multi-stage potty training assembly on which the present invention is useful.
Figure 2:
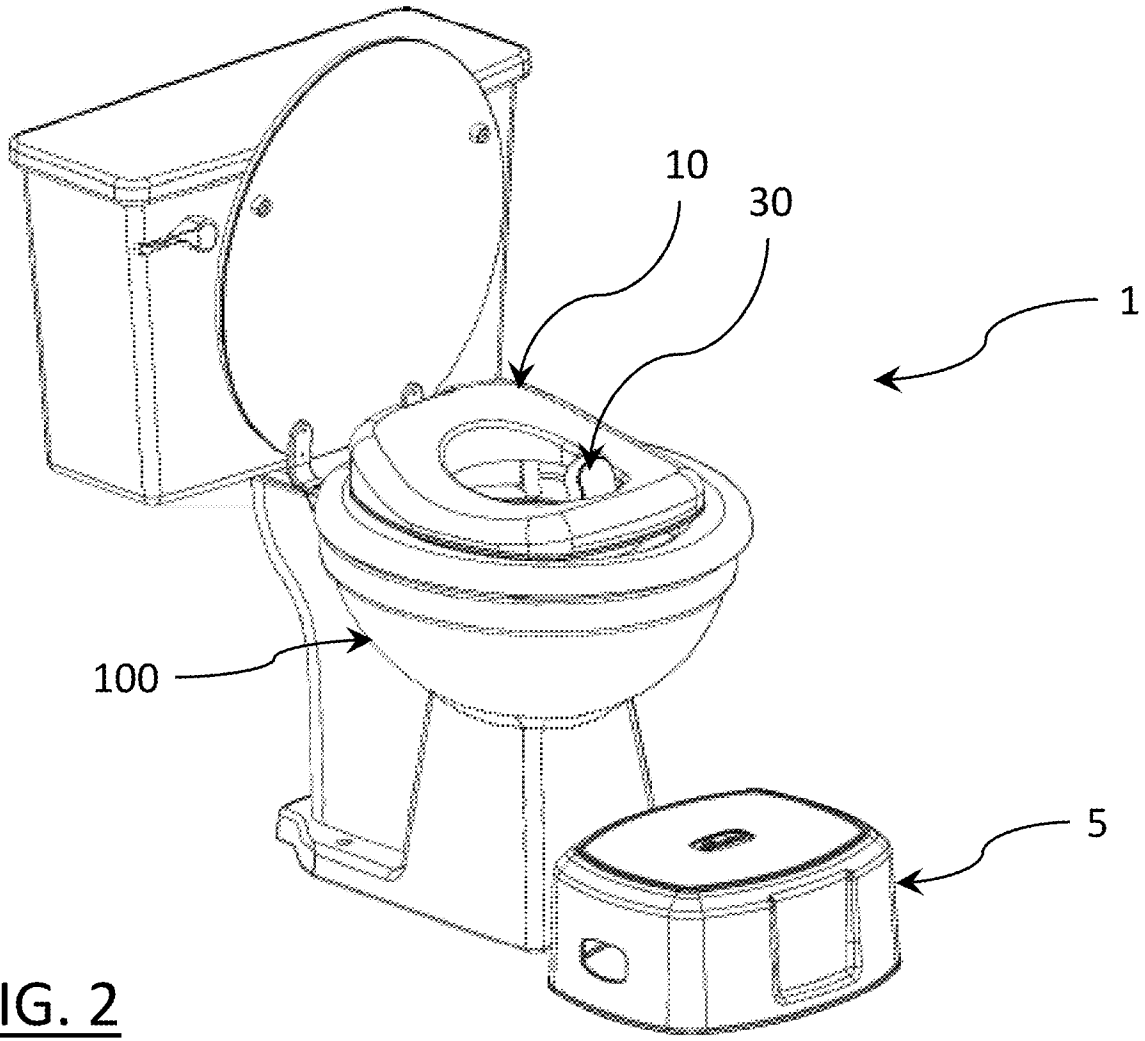
FIG. 2 is a view of a conventional toilet having a child's potty seat embodying one aspect of the present invention positioned thereon.

Referring to FIGS. 1 and 2, a multi-stage potty training assembly 1 for a child is shown comprising a base 5 and a potty seat 10. The potty seat 10 is configured to be positioned either on the base 5, positioning the seat at a level easily accessible by a young child, or on a conventional toilet 100, which may require a stool or the like to enable the child to access the seat in the elevated location atop a toilet. In the exemplar embodiment, base 5 may be inverted and used as a step for a child to gain access to the potty seat positioned atop a toilet. A collection container (not shown) may be positioned in the base when the training assembly is configured for stand-alone use.

The potty seat includes an opening 11 surrounded by a wall 12 extending generally vertically downward from a seating surface 14 configured to support a child. When positioned on a conventional toilet, wall 12 extended downwardly generally around the periphery of the opening 11, terminating an end 13. The potty seat may also include securing structures in the form of shields 16 and retainers 17 which may engage the inner opening of a conventional toilet seat 105 to securely position the potty seat on a toilet. The shields 16 are positioned to engage a portion of a corresponding opening in the regular toilet seat and extend downwardly toward the toilet bowl to prevent inadvertent spray from a child from being expelled through any gaps between the child potty seat 10 and the toilet seat. Retainers 17 may be provided to inhibit upward movement of the potty seat to reduce the risk of inadvertent separation of the potty seat from the toilet. The retainers 17 may be configured as lateral extensions positioned slightly below the toilet seat and extend beneath the toilet seat to inhibit uplift of the potty seat when so engaged. Retainers 17 may be formed from resilient material to allow deflection from a normal, laterally extending configuration as they pass through the toilet seat opening as the potty seat is moved into and out of engagement with the toilet. The retainers 17 may also be moveable in relation to the potty seat.

The potty seat 10 and base 5 may be formed from a variety of materials using a variety of forming methods. The potty seat and base 5 are preferably formed from molded plastic material selected for light weight, durability, ease of manufacturing, and ease of cleaning/disinfecting the surfaces.

The potty seat 10 also includes a rotatable splash guard 30 that may be connected to the seat adjacent a forward end 18 of opening 11. The splash guard 30 is configured with a generally concave cup-like interior surface 32 to deflect errant urine spray and direct the flow into the toilet or collection container beneath. The splash guard 30 may be generally elongated or elliptical in form defining a longitudinal axis 120 between opposing first and second ends 33, 35 of the splash guard 30 and having a minor axis transversely oriented. The shape is configured so the width along the minor axis fits comfortably between the child's legs and the longitudinal axis provides sufficient length to deflect errant spray and direct it into the toilet.

A generally cylindrical mounting projection 36 may extend from a generally convex exterior surface 34 opposite of the concave interior surface and defines a rotational axis 110 of the splash guard 30. The projection 36 may include a flange 37 disposed at its distal end and spaced apart from the exterior surface 34. The outer periphery of flange 37 extends beyond the surface of the projection 36 to limit axial movement of the splash guard in the direction of the cylindrical projection. The flange 37 may have a round profile concentric with the cylindrical projection 36.

The splash guard 30 and projection 36 may be formed from a resilient material. The resilient material may be silicone rubber or similar that provides resilient flexibility, is impervious to liquids and easy to clean. Splash guard flexibility may also improve comfort for the child user as the guard will easily deform under pressure from the child's legs. Flexibility, particularly in portions of the guard, is also required to enable attachment of the splash guard to the potty seat.

A mounting receptacle 40 is disposed on the forward portion 12F of wall 12 and configured to selectively receive the projection 36. The mounting receptacle 40 may be configured as a slot 41, open from the lower end 13 of vertical wall 12 that allows the projection 36 to be received by upward translational motion in a direction generally perpendicular to the rotational axis 110. An interior portion 42 of the mounting receptacle slot defines a generally circular opening though wall 12 having diameter similar to or slightly smaller than that of the projection 36 which enables the projection to rotate once fully when engaged in the interior portion of the slot. When the projection 36 is engaged in the slot 41, flange 37 is disposed on an opposite side of wall 12 from the splash guard 30 to limit movement along the rotational axis 110 of the projection 36 and prevent the splash guard from being unintentionally dislodged from the slot by movement along the rotational axis 110. A retention portion 44 in the slot 41 defines an open space slightly narrower than the diameter of the circular portion 42. As the projection 36 is moved into the receptacle by upward translation motion, the projection resiliently compresses allowing it to pass through the reduced-width retention portion 44 and then decompresses to its circular cross section once disposed in the circular interior portion 42 to both retain the splash guard position in relation to the potty seat 10 and to permit rotation thereof about the rotational axis 110.

Figure 3:
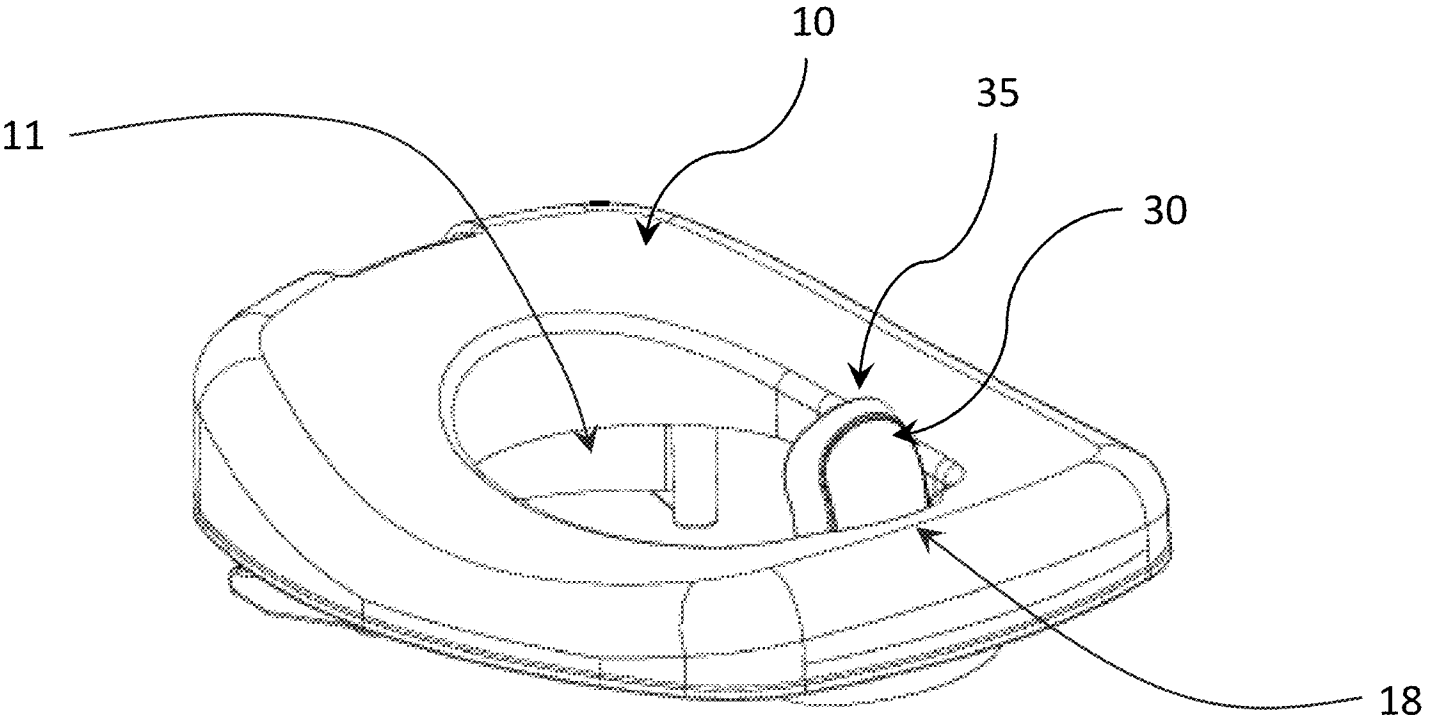
FIG. 3 is a view of a potty seat embodying an aspect of the present invention shown configured for use by boys.
Figure 4:
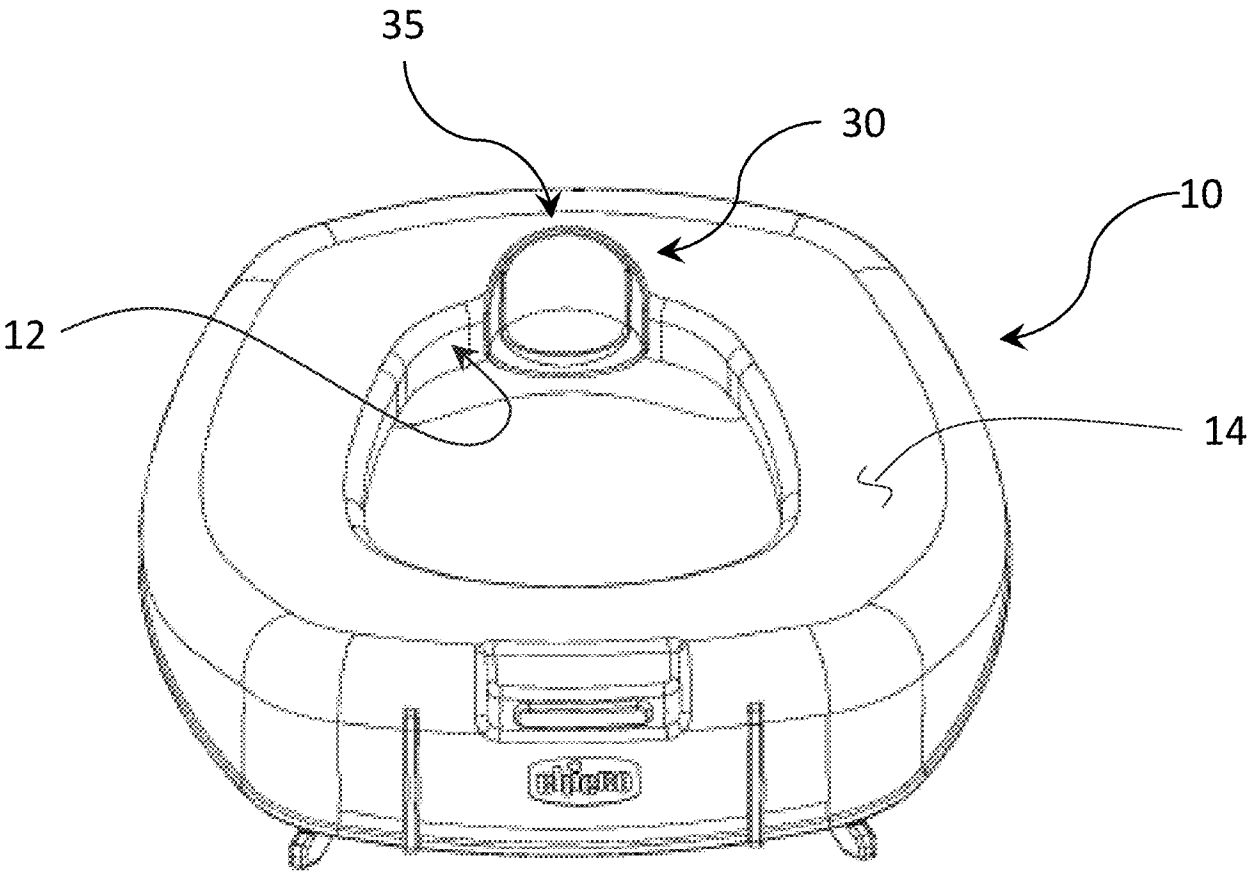
FIG. 4 is an alternate view of the potty seat shown as configured in FIG. 3.
Figure 5:
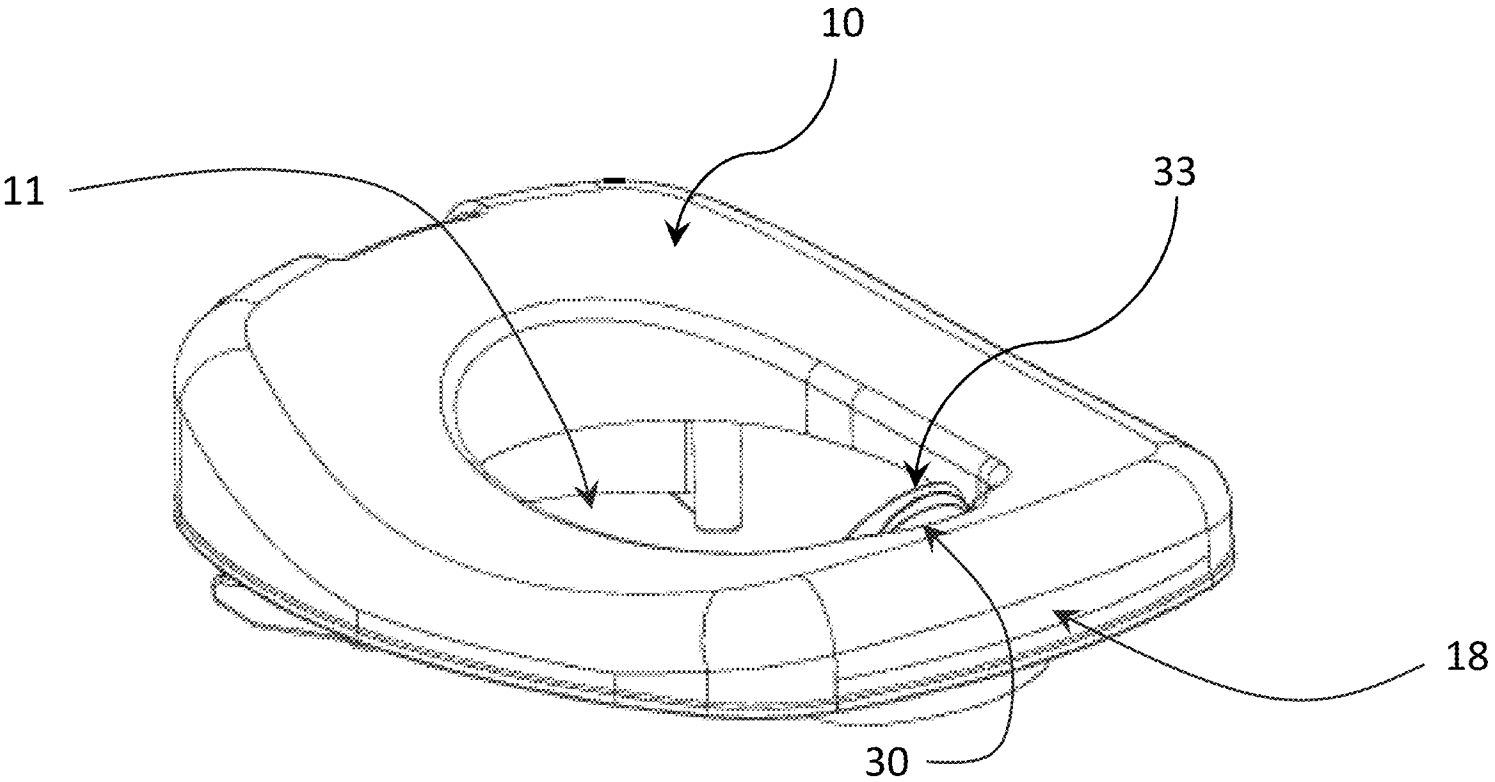
FIG. 5 is a is a view of a potty seat of FIG. 3 shown configured for use by girls.
Figure 6:
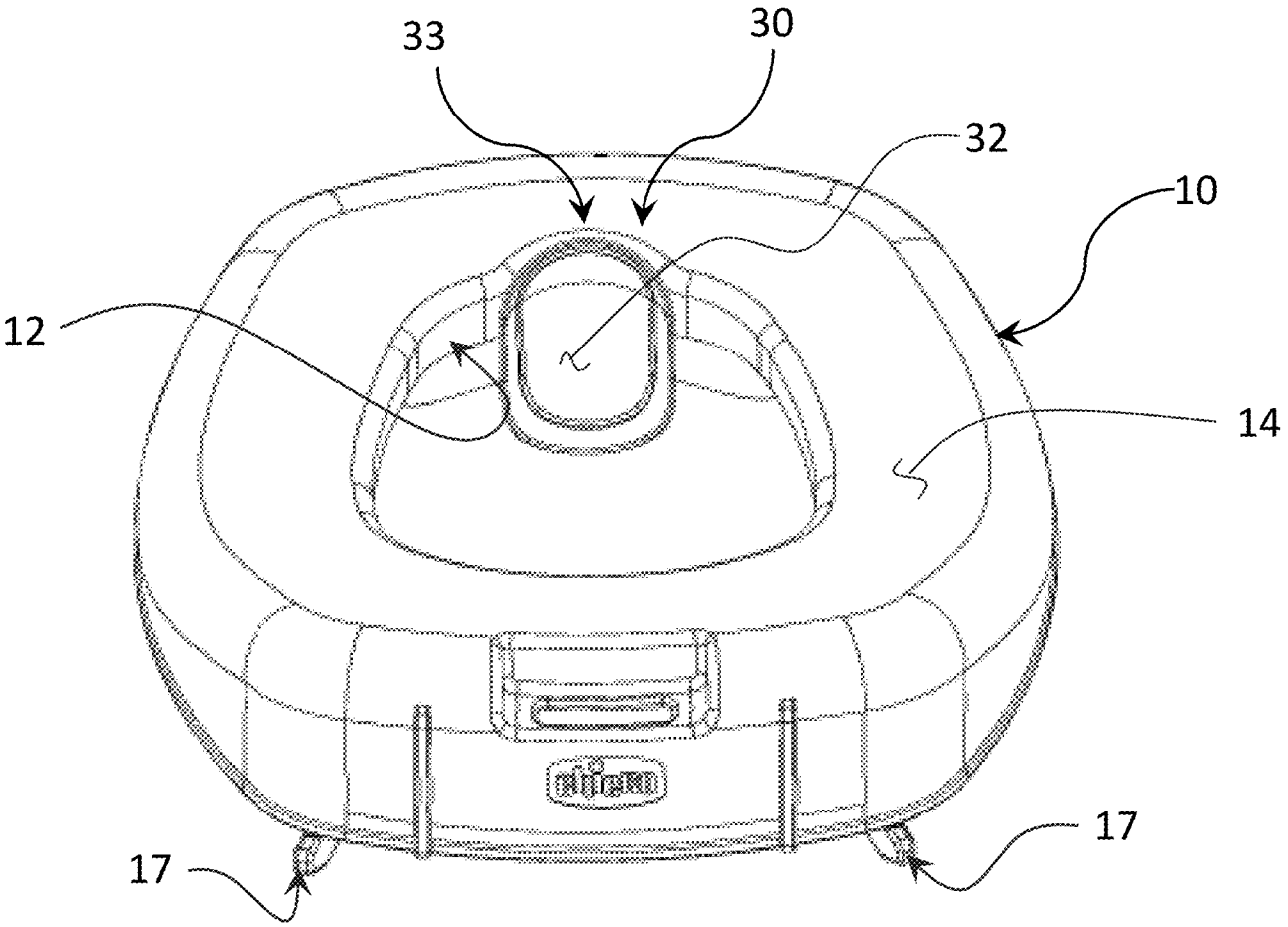
FIG. 6 is an alternate view of the potty seat shown as configured in FIG. 5.
Figure 7:
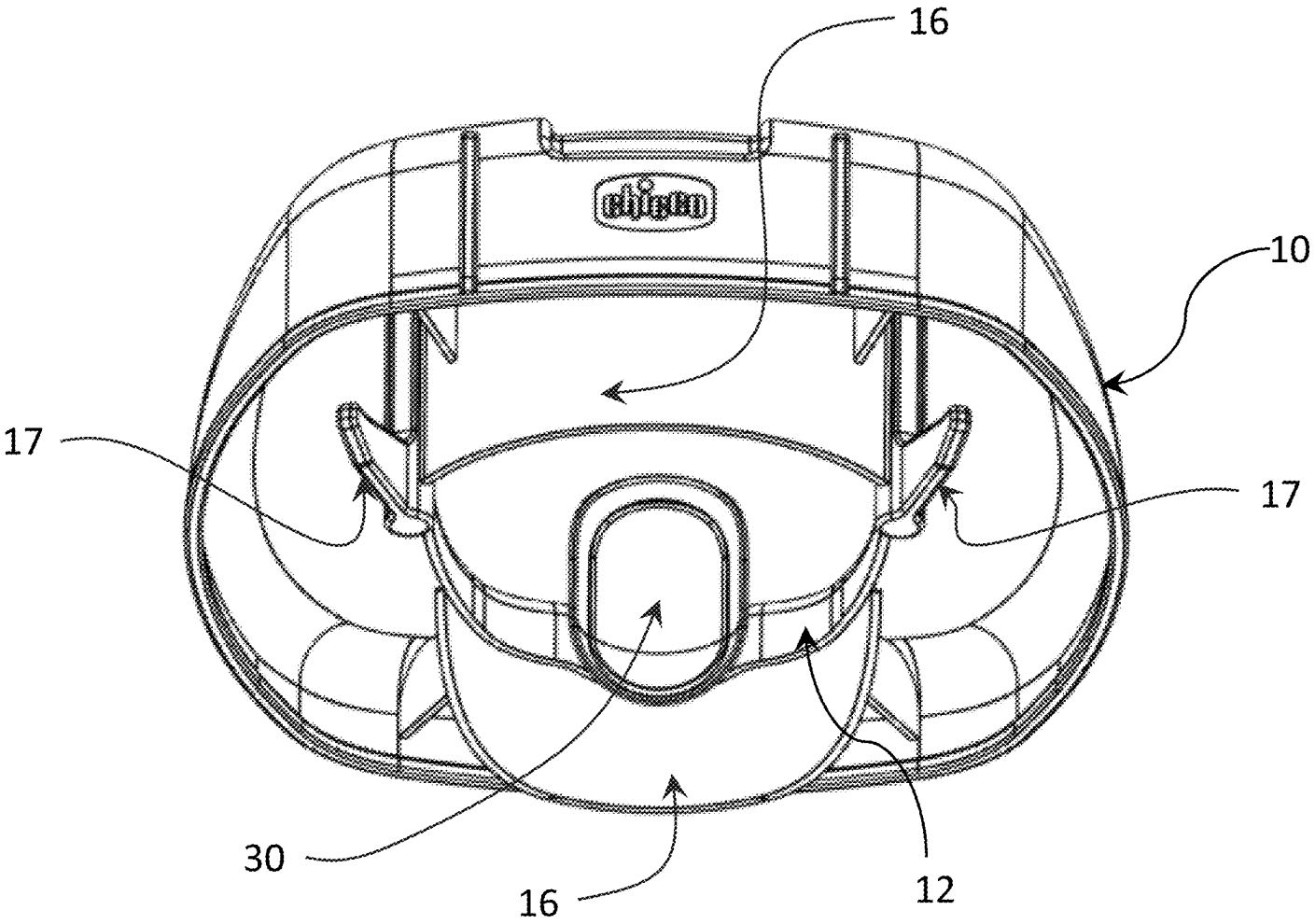
FIG. 7 is a view of the underside of an embodiment of the potty seat.

The splash guard 30 may be generally elongated or elliptical in form defining a longitudinal axis 120 between opposing first and second ends 33, 35 of the splash guard 30. The shape is configured to allow the splash guard to fit comfortably between the child's legs. The projection 36 is located along the longitudinal axis 120 between opposing first and second ends 33, 35 and projects from the exterior surface 34 of the guard. Projection 36 is eccentrically located along the longitudinal axis, being substantially closer to first end 33 than to second end 35. As a result of the eccentric positioning of projection 36 and the elongated or elliptical shape of the splash guard 30, rotation about rotational axis 110 causes an upward-oriented end of the splash guard to be located in a comparatively higher or lower position in relation to the seating surface 14 than when the splash guard is oppositely oriented. In the illustrated embodiment, when the splash guard is oriented so that first end 33 is upwardly oriented (FIGS. 5 & 6), first end 33 is located generally flush or slightly below the seating surface 14. This orientation is preferred for female users of the potty seat. When the splash guard is oriented so that second end 35 is upwardly oriented (FIGS. 3 & 4), second end 35 is located substantially above the seating surface 14. This orientation is preferred for male users of the potty seat.

One or more detents 46 are provided in the forward portion 12F of wall 12 adjacent to the interior portion 42 of mounting receptacle 40. The detents 46 may be engaged by a fixing structure 38 provided on the exterior surface 34. The detent 46 and fixing structure 38 are configured to retain the splash guard 30 in at least one of two rotational positions corresponding to positioning either the first end 33 or the second end 35 upwardly so that the seat is configured for use by female or male users, respectively. The detents may be aligned on a transverse axis 130 of the splash guard, the transverse axis 130 being oriented at a right angle to longitudinal axis 120. The fixing structures 38, being form from the same resilient material as the splash guard 30 may momentarily deflect as the splash guard as rotated into the desired orientation and then engage the detents 46 to hold the splash guard in position.

FIGS. 12-15 illustrate an alternate embodiment of a rotatable splash guard adaptable for use with a conventional seat 105 on a toilet. The alternate splash guard 150 is similarly configured with a generally concave cup-like interior surface 32 to deflect errant urine spray and direct the flow into the toilet beneath. The alternate splash guard 150 may be generally elongated or elliptical in form defining a longitudinal axis 120 between opposing first and second ends 33, 35 of the splash guard 150 and having a minor axis 130 transversely oriented. The shape is configured so the width along the minor axis 130 fits comfortably between the child's legs and the longitudinal axis provides sufficient length to deflect errant spray and direct it into the toilet.

The alternate splash guard 150 may be secured to the toilet seat 105 by a mounting apparatus comprising a strap 160 configured to encircle the toilet seat. The strap 160 is configured to allow a user to selectively adjust the strap length encircling the toilet seat so it may be securely connected thereto. The strap 160 may include a length adjuster including a fastener 162 selectively engageable in one of a plurality of receivers 164 configured to allow the length of the strap encircling the toilet seat to be selectively adjusted by a user. The strap is preferably constructed from a resilient material, allowing it to elastically stretch around the toilet seat so that it remains stationary once installed. The strap may be formed from silicone rubber or similar material that provides resilient flexibility, is impervious to liquids, and is easy to clean.

Figure 8:
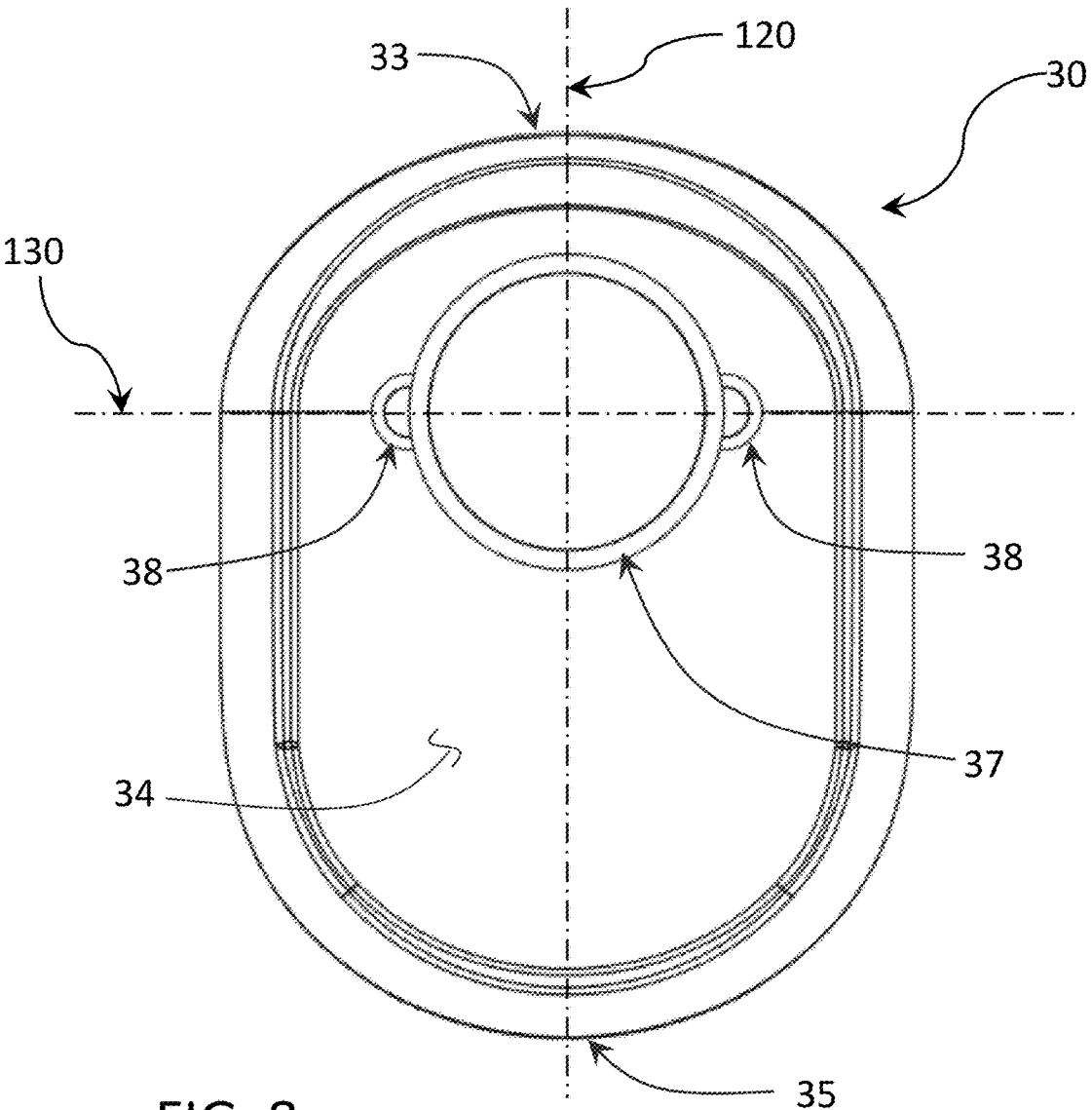
FIG. 8 is a front elevation view of an embodiment of a splash guard.
Figure 9:
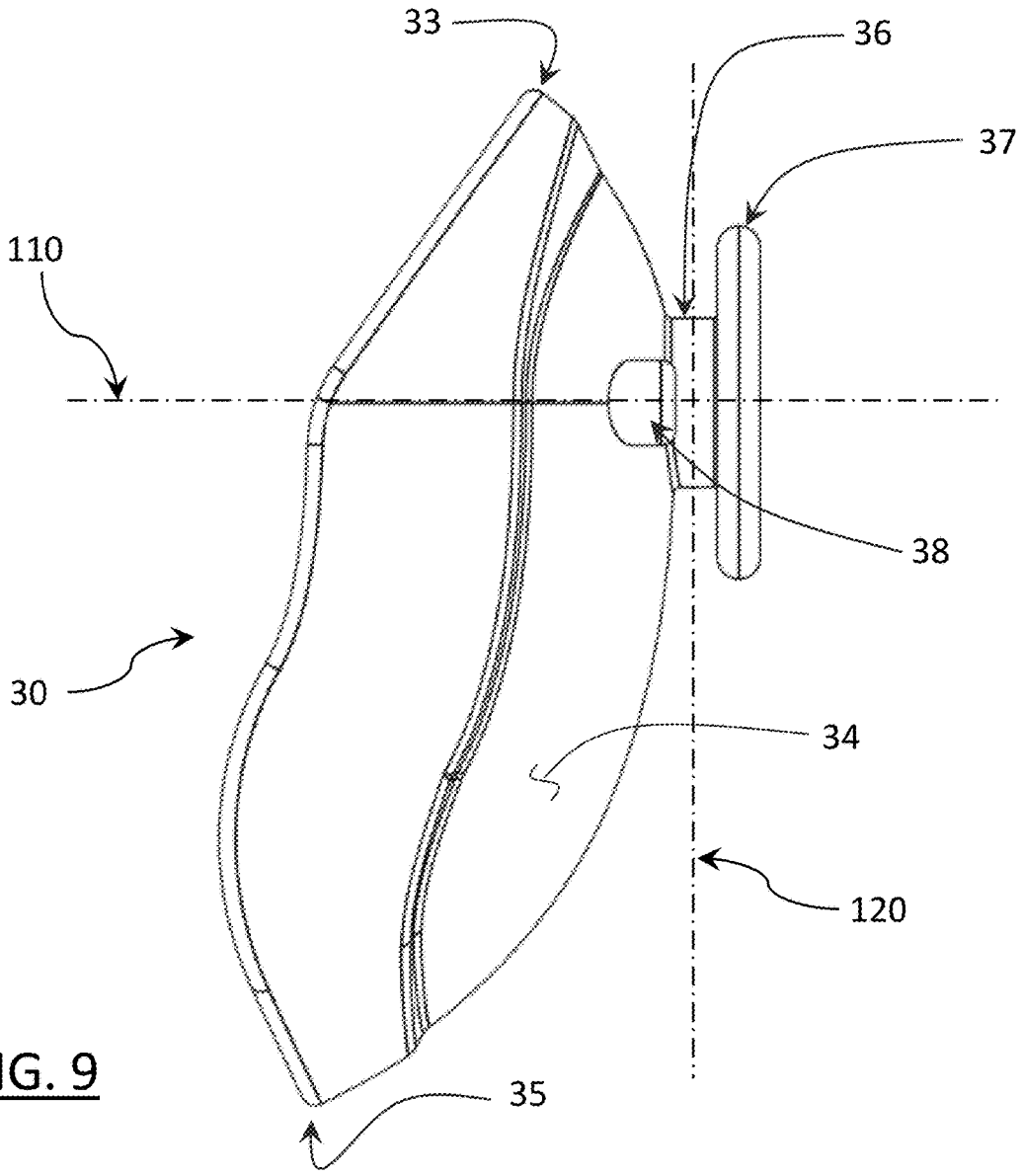
FIG. 9 is a side elevation view of the splash guard shown in FIG. 8.
Figure 10:
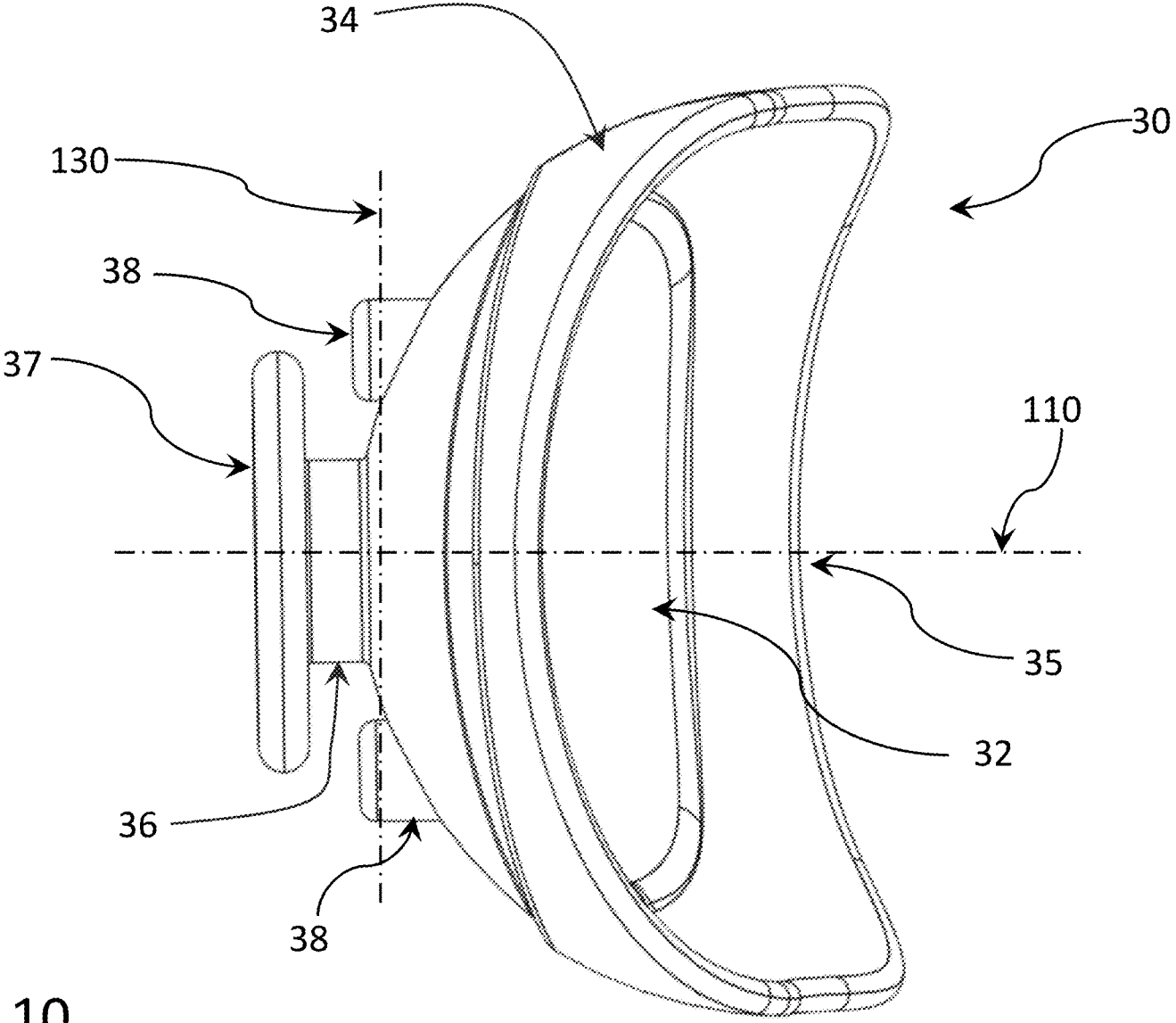
FIG. 10 is a top view looking down on the splash guard shown in FIG. 8.
Figure 11:
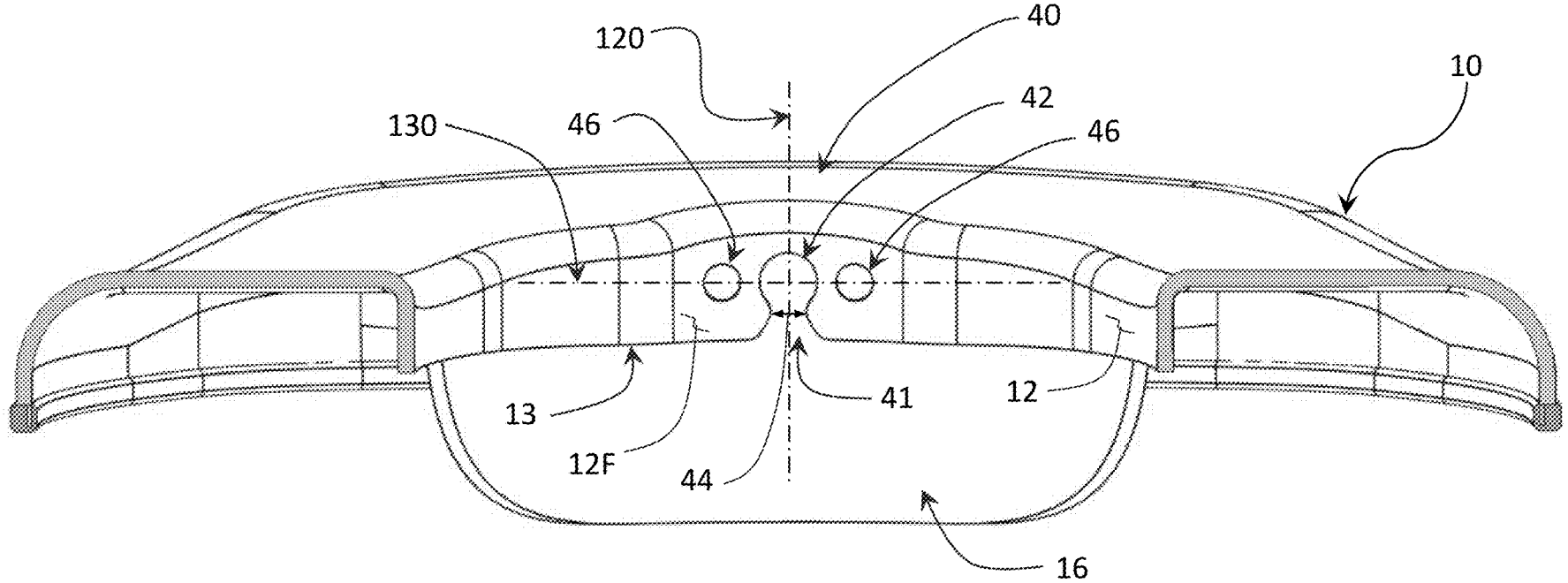
FIG. 11 is a partial view of a section of the potty seat looking forwardly showing details of the splash guard connection.
Figure 12:
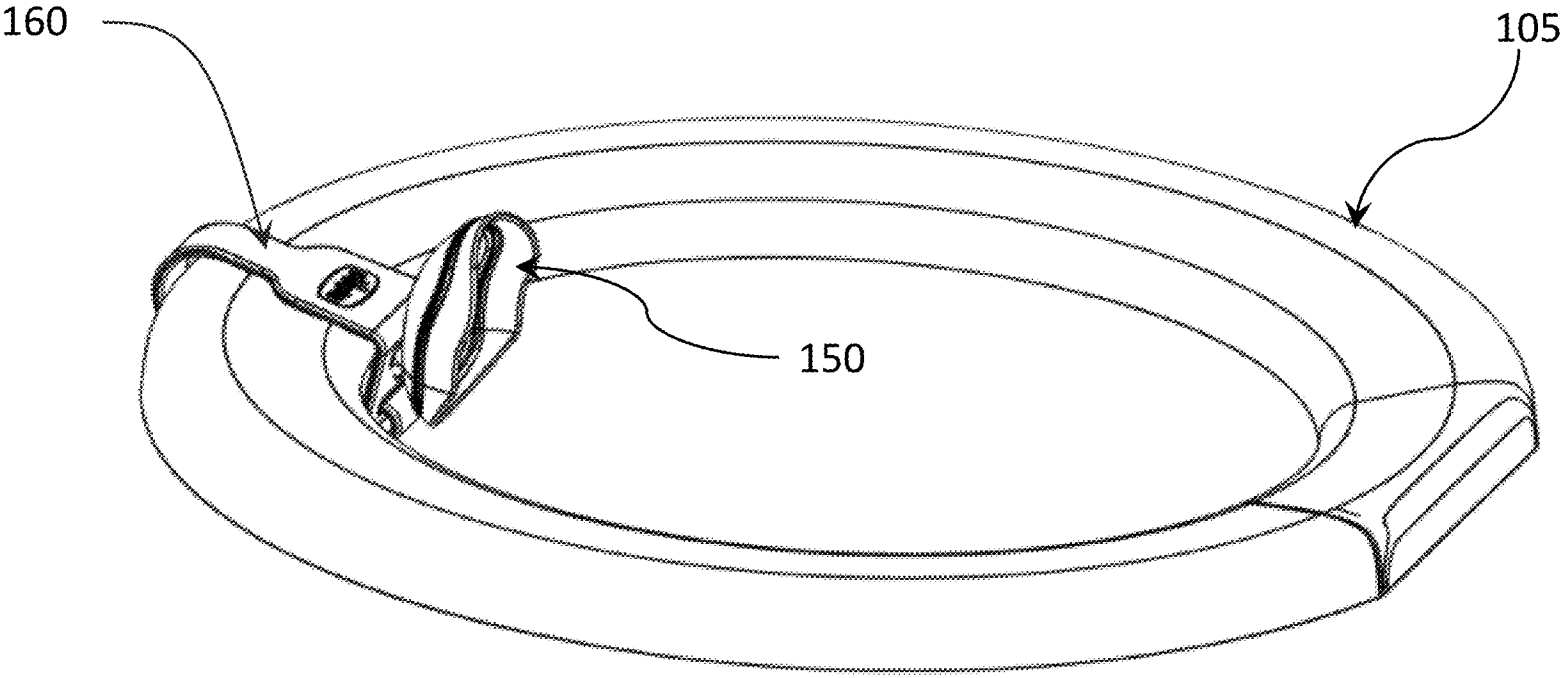
FIG. 12 is an alternate embodiment of a splash guard mountable on a toilet.
Figure 13:
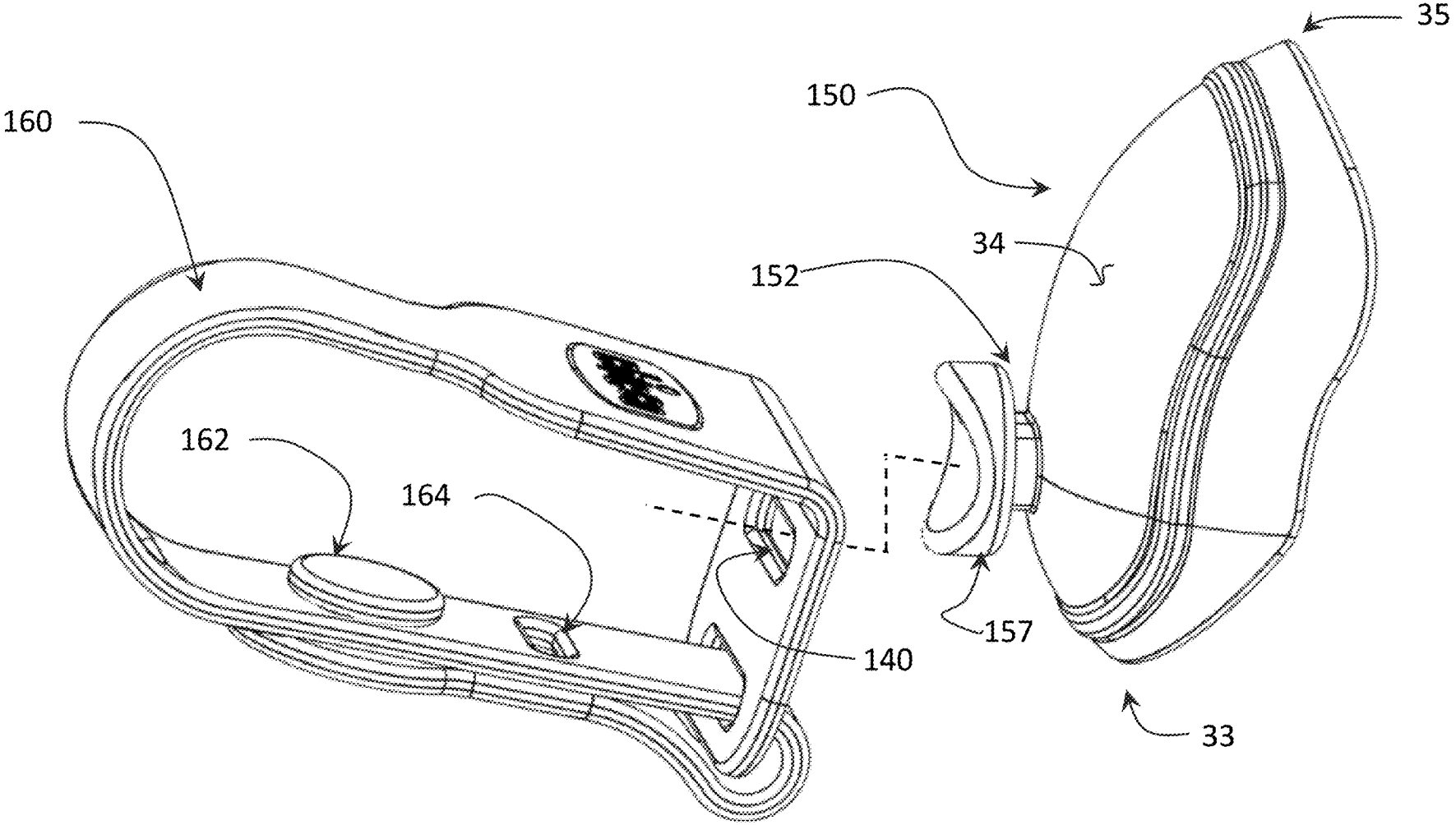
FIG. 13 illustrates the alternate embodiment of FIG. 12 with the splash guard and mounting strap shown separated.
Figure 15:
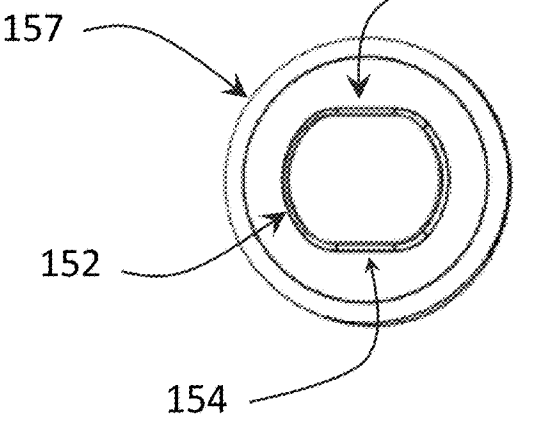
FIG. 15 is a section view of a portion of the splash guard shown in FIG. 14 taken along cut line 15-15.
Figure 14:
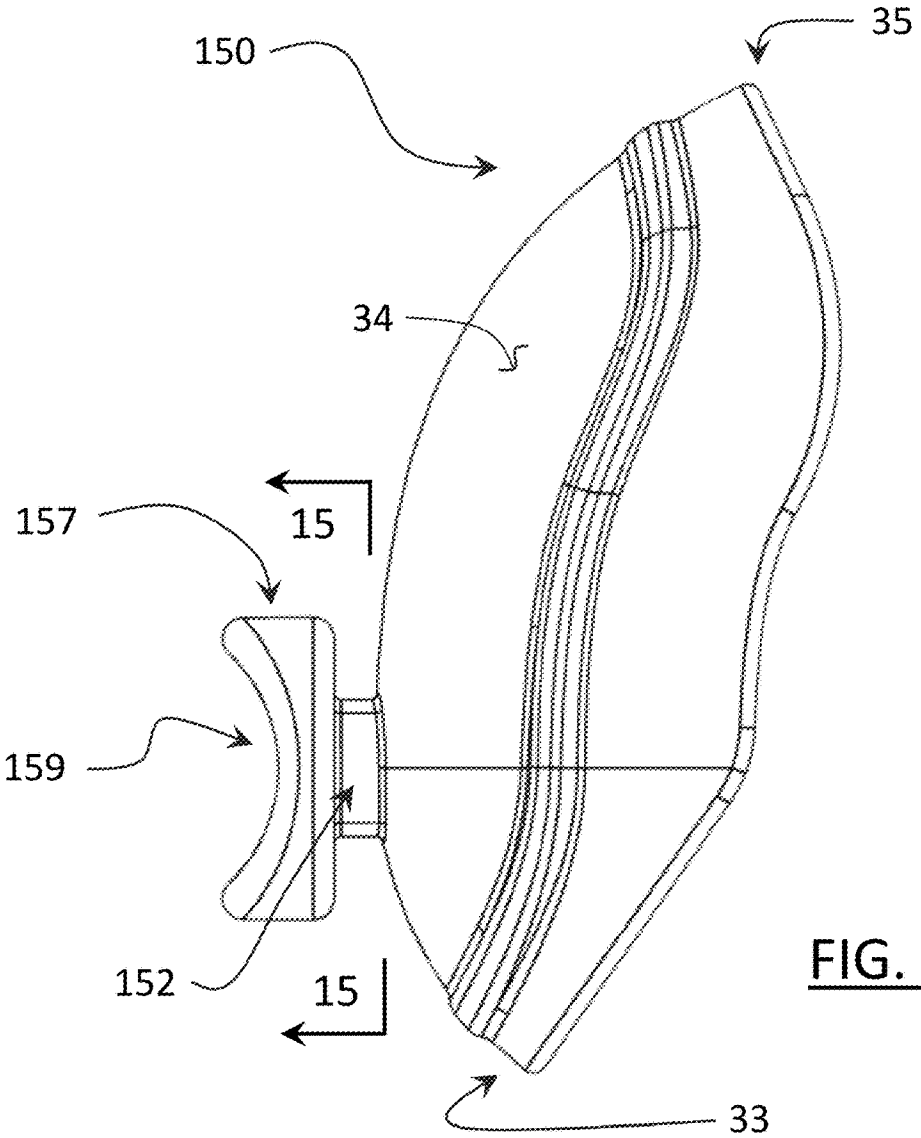
FIG. 14 is a side view of the splash guard shown in FIG. 12.

The alternate splash guard 150 may include a projection 152 located along the longitudinal axis 120 between opposing first and second ends 33, 35 that extends from the exterior surface 34 of the splash guard. Projection 152 is configured to engage a mounting receptacle 140 and secured the splash guard to the mounting strap 160. Projection 152 may be generally cylindrical in form and include a fixing structure in the form of surface profile including a first flat 153 and a second flat 154 which interface with the interior edges of mounting receptacle 140 to retain the splash guard so that the first end 33 or the second end 35 remain upwardly oriented. Projection 152 may include other cross-sectional profiles including flats 153, 154 to retain the splash guard in a desired orientation when engaged in the mounting receptacle. The mounting receptacle 140 may be configured as a rectangular opening, or any other shape capable of receiving the projections 152. The mounting receptacle 140 shape and the projection 152 cross section may be configured to match each other or the receptacle may differ and rely on the elasticity of the strap material to conform to the projection. A projection and separate fixing structure as previously described and illustrated in FIGS. 8-10 may be provided and the receptacle 140 configured to receive the fixing structure when the splash guard is properly oriented to maintain it in that position. A flange 157 is provided on a distal end of protection 152 and spaced apart from the exterior surface 34 of the splash guard to retain the projection 157 engaged in the mounting receptacle 140. The flange 177 may include a contoured surface 159 configured to generally match the contour of an inner rim of a conventional toilet seat 105 to further maintain desired orientation of the splash guard 150 in relation to the toilet seat.

While the exemplary embodiments illustrated in the figures and described herein are presently preferred, it should be understood that these embodiments are offered by way of example only. Accordingly, the present application is not limited to a particular embodiment but extends to various modifications that nevertheless fall within the scope of the appended claims. The order or sequence of any processes or method steps may be varied or re-sequenced according to alternative embodiments.

It is important to note that the construction and arrangement of the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present application. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating conditions and arrangement of the exemplary embodiments without departing from the scope of the present application.

The invention claimed is:

1. A potty seat adaptable for sit-down use on a toilet comprising:

a child-sized seat having a seating surface and a mounting receptacle; and a splash guard rotatably mounted to the seat via a cylindrical projection received in the mounting receptacle, the splash guard being rotatable about a rotational axis between a first and a second orientation;

wherein the cylindrical projection is eccentrically positioned relative to the splash guard such that rotation of the splash guard varies a vertical height of the splash guard relative to the seating surface;

wherein the splash guard further comprises a fixing structure and the seat includes a corresponding detent;

wherein the fixing structure is configured to selective engage the detent to retain the splash guard in each of the first orientation and the second orientation; and wherein an end of the splash guard is located higher in relation to the seating surface in the first orientation than in the second orientation.

2. The potty seat of claim 1, wherein the child-sized seat further comprises an opening, the opening having a downwardly extending skirt, the mounting receptacle being disposed on the skirt.

3. The potty seat of claim 2, wherein the receptacle comprises a slot in the skirt open to a lower end of the skirt, the slot having a circular interior portion configured to receive a portion of the projection and enable rotation of the splash guard about the rotational axis.

4. The potty seat of claim 3, wherein the projection further comprises a distally disposed flange spaced apart from the splash guard and disposed on an opposite surface of the skirt from the splash guard when the projection is engaged in the receptacle, the flange configured to limit movement of the splash guard along the rotational axis relative to the skirt.

5. The potty seat of claim 4, wherein the detent is disposed on the skirt adjacent to the receptacle and the fixing structure is disposed adjacent to the projection.

6. The potty seat of claim 1, wherein the splash guard comprises a generally concave interior surface and a generally convex exterior surface, the projection extending from the exterior surface along the rotational axis.

7. The potty seat of claim 1, further comprising a resilient retainer engageable with the toilet, the retainer extending laterally beneath a lower surface of a seat on the toilet and engageable therewith to inhibit upward movement of the potty seat.

8. A child potty seat adaptable for sit-down use on a toilet by male and female users, the child potty seat comprising:

a seating surface with a forwardly-rearwardly extending opening and a downwardly extending skirt;

a mounting receptacle disposed on a forward end of the skirt;

a splash guard having a first end and a second end spaced apart along a longitudinal axis; and a projection extending along a rotational axis from a surface of the splash guard and eccentrically positioned between the first and second ends, the projection being rotatably engageable in the mounting receptacle aligning the rotational axis forwardly-rearwardly to the seating surface;

wherein the splash guard further comprises a fixing structure engageable in a detent disposed on the skirt, engagement therein selectively fixing the splash guard with either the first end or the second end upwardly oriented;

wherein rotating the splash guard between a first orientation and the second orientation while the projection is engaged in the mounting receptacle upwardly positions the first end or the second end, respectively, and the first end being located higher above the seating surface when upwardly oriented than the second end when it is upwardly oriented.

9. The child potty seat of claim 8, wherein the splash guard comprises a generally concave interior surface and a generally convex exterior surface, the projection extending from the exterior surface along the rotational axis.

10. The child potty seat of claim 8, wherein the receptacle comprises a slot in the skirt open to a lower end of the skirt, the slot having a circular interior portion configured to receive a portion of the projection and enable rotation of the splash guard about the rotational axis.

11. The child potty seat of claim 10, wherein the detent is disposed on the skirt adjacent to the receptacle and the fixing structure is disposed on the exterior surface adjacent to the projection.

12. The child potty seat of claim 8, further comprising a resilient retainer engageable with the toilet, the retainer extending laterally beneath a lower surface of a seat on the toilet and engageable therewith to inhibit upward movement of the potty seat.

13. A splash guard for use with a toilet seat comprising:

a concave interior surface spanning between generally opposing first and second ends;

a convex exterior surface oppositely disposed from the interior surface; and a projection extending from a surface of the splash guard and eccentrically positioned between the first and second ends, the projection further comprising a fixing structure engageable in a receptacle configured to retain the splash guard in a preferred orientation; and a mounting apparatus including the receptacle, the mounting apparatus selectively connectible to the toilet seat, the mounting apparatus retaining the splash guard in the preferred orientation in relation to the toilet seat, the preferred orientation arranging the splash guard with either the first end or the second end being upwardly oriented.

14. The splash guard of claim 13, wherein the fixing structure includes a surface profile engageable with a portion of the receptacle.

* * * * *